United States Patent [19]

Doyle et al.

[11] 4,017,002

[45] Apr. 12, 1977

[54] DISPENSING MOIST TREATED TOWELS OR TISSUES

[75] Inventors: Ross L. Doyle, Ramsey, N.J.; Thomas S. Harrison, New Canaan, Conn.

[73] Assignee: Sterling Drug Inc., New York, N.Y.

[22] Filed: Jan. 11, 1974

[21] Appl. No.: 432,620

Related U.S. Application Data

[63] Continuation-in-part of Ser. No. 856,096, Sept. 8, 1969, abandoned, and a continuation-in-part of Ser. No. 128,800, March 29, 1971, abandoned, and a continuation-in-part of Ser. No. 222,882, Feb. 2, 1972, abandoned.

[30] Foreign Application Priority Data

Apr. 1, 1970 United Kingdom ..... 15535/70
Aug. 10, 1970 Canada ..... 92035

[52] U.S. Cl. ..... 221/63; 206/205
[51] Int. Cl.[2] ..... B65H 1/00
[58] Field of Search ..... 118/506, 43, 37, 405, 118/419, 420; 225/106; 206/63.5, 56 R, 58, 205, 210, 390; 128/169, 170; 221/51, 63

[56] References Cited

UNITED STATES PATENTS

| | | | |
|---|---|---|---|
| 2,004,614 | 6/1935 | Meagher | 206/63.5 |
| 2,806,591 | 9/1957 | Appleton | 225/106 |
| 3,368,522 | 2/1968 | Cordis | 118/43 |

FOREIGN PATENTS OR APPLICATIONS

| | | | |
|---|---|---|---|
| 7,721 | 4/1899 | United Kingdom | 128/169 |

*Primary Examiner*—Morris Kaplan

[57] ABSTRACT

A substantially airtight container for an elongated web of perforated wet impregnated tissue-like material, the web being free-flowing and having a minimum of friction within the container, being manually pulled to be dispensed through a substantially closed but yielding slit in a wall of the container, the slit opening slightly to permit the exit of the web but tending to return to closed condition especially at its ends, to impart sufficient drag on the web to cause progressive severing of the web into separate sheets as the web is pulled through the slit, leaving a tip of the web still contained exposed to be grasped for the next dispensing step.

6 Claims, 18 Drawing Figures

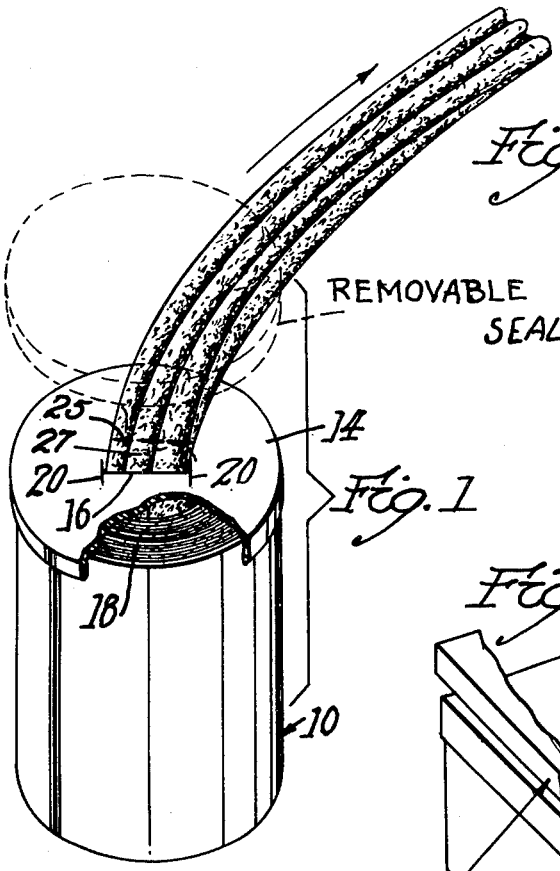
Fig. 1
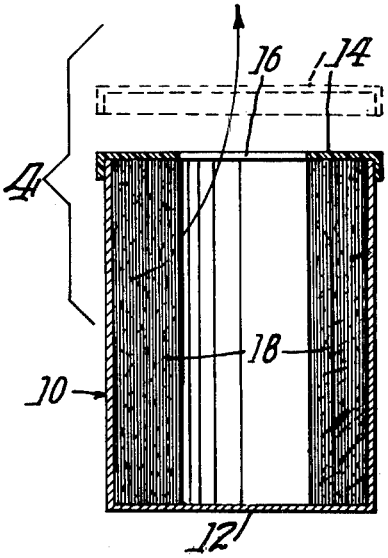
Fig. 4
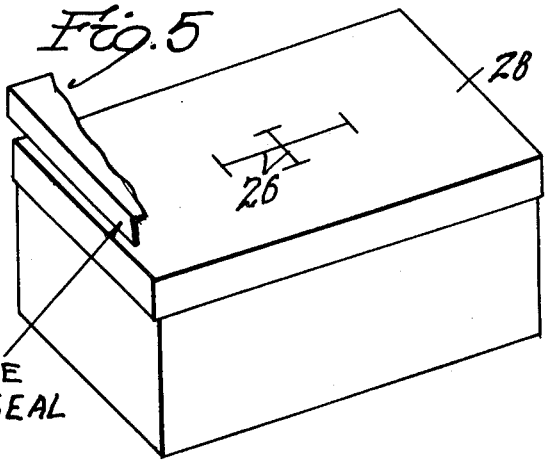
Fig. 5
Fig. 2
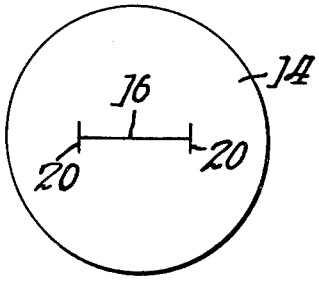
Fig. 3
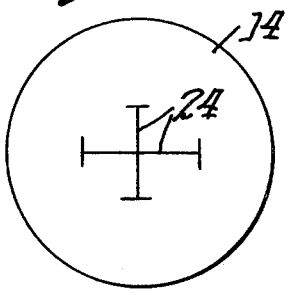

Fig. 9
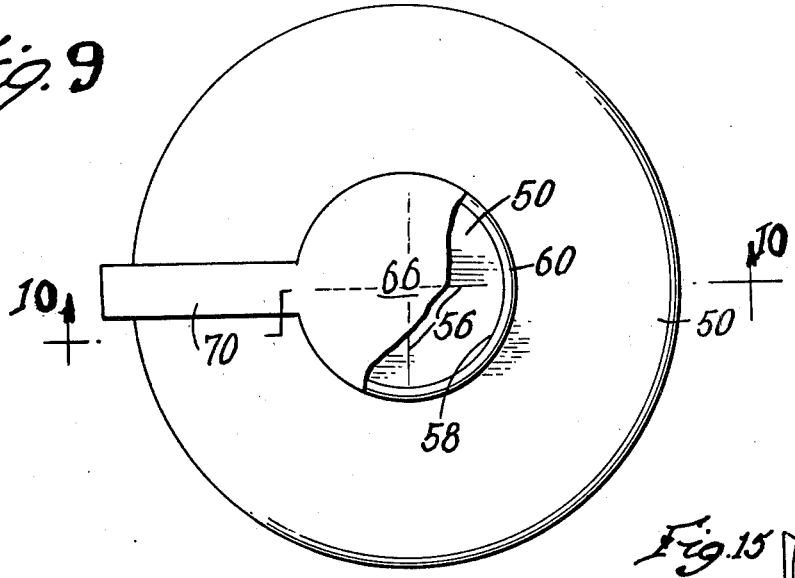
Fig. 15
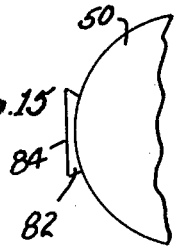
Fig. 10
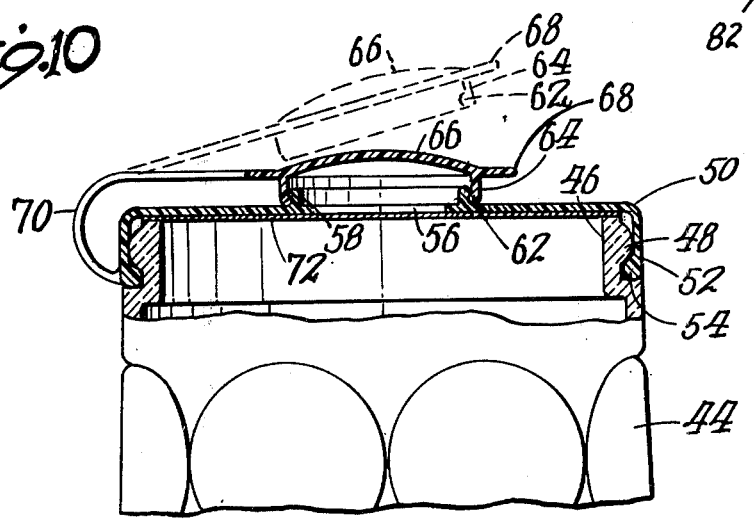
Fig. 11
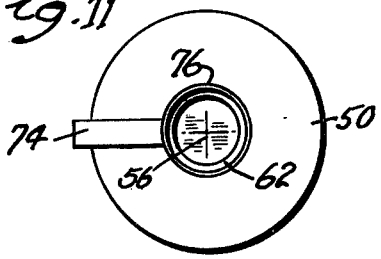
Fig. 13
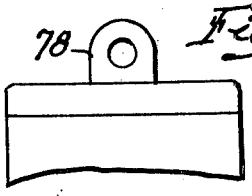
Fig. 12
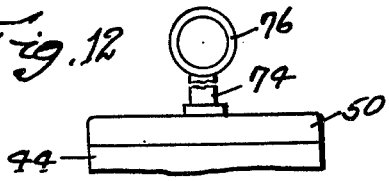
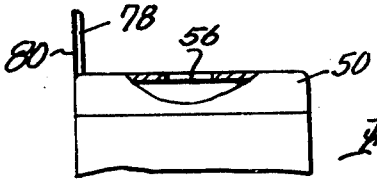
Fig. 14

DISPENSING MOIST TREATED TOWELS OR TISSUES

This case is a continuation-in-part of Ser. No. 856,096 filed Sept. 8, 1969, and Ser. No. 128,800 filed Mar. 29, 1971, and Ser. No. 222,882 filed Feb. 2, 1972, each application now abandoned.

BACKGROUND OF THE INVENTION

There has long been a very convenient wash and dry packet containing a single folded handkerchief-like impregnated tissue, the packet being sealed and easily torn open for personal use of the impregnated material. It has been observed that it often happens that these small packets must be used in multiples in order to accomplish the purpose, and it is the general object of the present invention to provide a continuous immediately available sheet supply from a continuous web with a single substantially airtight container, while still maintaining the contained toweling or tissues against drying out, without the necessity for opening individually sealed packets.

SUMMARY OF THE INVENTION

In accordance with the present invention there is provided a dispenser for wet impregnated material which comprises an enclosed airtight container having a slit in a wall thereof, a continuous supply of perforated tissue-like wet impregnated material in the form of a strip or web in said container, said web being capable of extraction through the slit, to be disrupted into separate sheets, one by one, at the perforations.

The web is placed in the container originally so that there is little or no resistance to flow of the web, that is, it is substantially friction free and free-flowing.

In a typical embodiment of the invention, the container is provided with a removable cap of resilient material adapted to form a tight fit with the container, the cap having a slit in it capable of forming a re-sealable, reclosable opening, the slit being of any suitable form or shape, e.g., a line or a cross. The treated (wet impregnated) material may be of any suitable kind including fabric, non-woven material, or paper of some wet strength, to be drawn out through the slit manually, whereupon it forms a rope-like member similar to a roving, which upon severance is conveniently used for the purpose indicated, i.e., washing, cleaning, wiping, insect repellant, etc. The material may be in the form of a coreless roll, the web being then drawn from the central void thereof, but other forms of supply may be used, e.g. an accordian pleated web, pack-folded web, or a web that is randomly stuffed into its container one end first, which is the last to exit. This packed web must be substantially free of friction and free-flowing.

The material is easily severed, facilitated by the provision of spaced transverse perforations, into individual e.g., handkerchief size individual sheets. The perforations, if desired, may be cut at an angle other than ninety degrees to the length of the continuous material. A small tip of the next sheet of the web protrudes through the slit on separation of the preceding sheet, leaving the major portion of the next sheet, as well as the rest of the web, inside the container, preventing evaporation. The slit is substantially closed, the lips thereof being contacting except for the presence of the web, and the slit forms the web into a roving or roping and applies just enough drag to the web to cause it to separate at the perforations, progressively, leaving a small tip of the succeeding tissue sheet exposed. This action may be enhanced by pulling the roped web in a direction to tend to gather it toward an end portion of the slit.

The container can be formed of any suitable material such as glass, metal, plastic, foil-paper laminate and combinations thereof. The slitted cap may be made of any suitable resilient material such as plastic which has a "memory" so that the lips of the slit therein return to original closed condition, after having been flexed enough to allow the web to be extracted. A seal in the form of a membrane or foil may be applied to underlie the slitted cap, this seal being removable prior to use e.g., by rupturing it. This seal may be in the form of a liner disposed in a cover for the slitted cap, or it may be sealed about the mouth of the container by conventional means.

The resilient slitted cap therefor may be fitted to the container in a conventional manner, e.g., it can be of the friction-fit, snap-on, or screw top type, etc. A cover for the slitted cap may be used, if desired, and may be fitted to the container by conventional methods, such as described for the slitted cap. The cover may be separate, or it may be captive to the slitted cap.

A captive apertured tab may be provided to hang or suspend the dispenser as by a hook or by the roll of a toilet paper fixture; alternatively, pressure sensitive tabs or bosses can be used to secure the dispenser to a wall or outer support in a convenient location.

The container may be of any convenient shape, but where it is e.g., square or rectangular, it is preferred to pack-fold or accordian pleat it; but containers of any shape can be used with the randomly stuffed in web. The web is wet impregnated and the construction and operation of the package is such as to cause progressive rupture of the web into sheets while leaving a tip or tail of the web extending outwardly just about enough to provide a fingergrip for the next pull, but not enough to cause subsequent drying out of a portion of the next sheet, so that it becomes too dry for the purposes indicated.

The resistance of the slit to the web, the fabric strength, and the degree of perforation are such as to ensure successful operation as described above, but it is to be noted that the web must rope as it is withdrawn, from a substantially frictionless compacture in the container, and the severance occurs progressively, so that when the ropy web is pulled out and severed, an exposed tip remains for the next dispensing action.

The severance starts adjacent to an end of the slit, this portion of the slit grasping the rope more tightly, the part of the rope which is intermediate the slit ends being grasped to a lesser degree. That is, as the rope is being withdrawn the severance of the rope starts in that portion of the rope which is most closely adjacent the slit end, and the web is at first further weakened as it is withdrawn from the container until it is completely severed, but not until that portion of the rope intermediate the ends of the slit has been withdrawn somewhat beyond the slit, that is, outwardly of the container, leaving the tip of the next sheet exposed to an extent so that it is capable of being grasped for the next sheet extraction. Therefore it will be seen that the severance is not accomplished instantaneously, but progressively as the roped web moves outwardly. Also, the next sheet is held by the reclosed edges of the slit and prevented from dropping back into the container.

It will therefore be seen that in order to provide the exposed tip which is necessary for the succeeding sheet extraction, there are two motions which are necessary, the progressive severance starting at the part of the rope which is closest to the end of the slit and continuing thereafter from that point to the opposite side of the rope, while at the same time the rope is moving outwardly while being withdrawn from the container.

BRIEF DESCRIPTION OF THE DRAWINGS

FIG. 1 is a perspective view partly in section illustrating a form of container and the manner of withdrawing the sheet from a roll therein;

FIG. 2 is an end view of the container illustrating a form of the slit;

FIG. 3 is a similar view of FIG. 2 showing a different form of slit;

FIG. 4 is a longitudinal section through the container and roll of material;

FIG. 5 is a perspective view showing a modification;

FIG. 9 is a plan view of another modification, parts being broken away;

FIG. 10 is a section on line 10—10 of FIG. 9;

FIG. 11 is a plan view on a smaller scale of a modification of the form of the invention shown in FIGS. 9 and 10;

FIG. 12 is a view in elevation showing the hanging ring of FIG. 11;

FIG. 13 is a view in elevation of a modification of the form of the invention shown in FIGS. 11 and 12;

FIG. 14 is a view in elevation partly in section looking in the direction of arrow 14 in FIG. 13;

FIG. 15 is a partial view in elevation showing an integral boss on the cap for adhesively applying the same to a support;

PREFERRED EMBODIMENTS OF THE INVENTION

Figure 6:
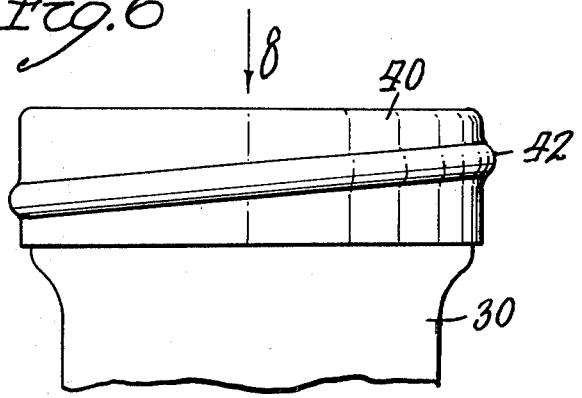
FIG. 6 is a view in elevation of another modification.

With reference to FIGS. 1 – 4, a container 10 having a closed end 12 and of any suitable type for the use intended as appears hereinafter, is provided with a removable seal 13, shown in dotted lines, FIG. 1, maintaining the contents of the container against evaporation or leakage of any kind, prior to use. This seal may be connected in any way to the container and is easily removable by the consumer in a manner well known, as by a pull strip, can opener, screw threads, etc.

With the seal removed, a cap 14 of resilient material forms a tight fit with the open end of the container. This cap may originally overlie the said seal being removable from the container and applied to the open end after the seal is removed. Cap 14 is provided with a slit 16 having slightly yielding edges to form an opening providing for extraction of the container contents, but the slit is normally closed with the edges thereof being in contacting relation due to the resiliency of the elastomeric material of which it is made, and the fact that no material is removed in forming this slit. The slit will yield to a greater extent at its center portion than at its ends. The container is therefore substantially airtight even under conditions of use.

A roll of tissue, toweling, or any suitable material, impregnated with e.g. perfumed insect repellant, polishes, skin medicaments, cleaning fluids, etc., is indicated at 18. Before the cap 14 is applied, the inner end of the roll, which is shown as coreless, can be grasped manually and thrust outwardly through the slit 16. With such a coreless roll there is little or no friction internally and the web may be extracted freely without any resistence except for that occasioned by the slit.

The slit 16 is considerably shorter than the width of the sheet material being withdrawn, and this causes the material to "rope" as it passes through the slit, in effect folding into a roving, so that it is bunched up. The form of the slit may be varied greatly. The main slit 16 may have cross slits 20 at its ends. Cross slits 20 are shorter than the slit 16 and act to allow the edges of the latter to bend to provide for easy flow of the tissue or towel rope as it is being pulled while still providing for a re-closing of the slit to avoid drying out.

The slit may be made in the form of a cross as at 24, FIG. 3, and of course the lengths thereof are dependent in some respects on the consistency of the material of the supply 18. Upon pulling the web outwardly, the web appears in the form of a roving or the like, and since it is thus bunched, it tends to gather in part adjacent an end of the slit, and greater "grasp" on the web is imparted by the edges of the slit in this area, so as to insure starting the severance at the perforations 25 that are closest to the slit end.

If the feed is lost, i.e., if the leading end of the material does not project, the cap is removed and the feed restarted and the cap reapplied. With a larger slit it is possible to reach into the container with the fingers to restart but the smaller the opening, the less is any possible evaporation. The toweling or tissue being severed at the perforations 25, a small leading end 27 of the next section is left to be pulled out and severed, when another towel or tissue is wanted. The slit provides just enough drag on the web to cause it to part at the perforations with the next leading end exposed.

The container is sealed tight for storage such that it can be placed on market shelves for extended periods of time. When subsequently purchased and readied for use by the consumer, the seal for the container is removed in a manner depending on the nature of the seal, discarded, and replaced by the slit cap which then generally remains in place until the tissues have been used up.

The successful operation of this package has been found to be dependent on several definite factors. One is the closeness of the edges of the slit. These edges must be in substantial contact but must be yieldable to allow the web to be pulled through. At the same time it has been found that the tendency is for the moist web to form into a rope or roving in gathered condition whereby it tends to move toward the end of the slit.

The compaction of the web within the container must be such that there is no friction internally to tend to restrict or impede the flow of the web as far as the slit. Should there be friction or retardation of any kind on the web in the container, the severance of the web would be below the level of the slit, leaving no extending tip for the next pull. Therefore the web must be in the form of a coreless roll with the inner end of the web at the center of the core being the end to be abstracted; or the web can be folded in zig-zag form, not interfolded. The web may also be placed in the container one end first and the rest of the web piling up on the already entered portion so that the last end of the web placed in the container is the first end of the web to be abstracted and the first end of the web to be placed in the container is the last part of the web to be abstracted.

It is necessary that the web be perforated, that the package be closed and substantially moisture tight; it is necessary that the web ropes as it issues from the slit and the slit edges must bend to an extent to allow the exit of the ropy web but return to original position to grasp the tip upon severance. In other words, the quality of memory of the plastic is relied upon, and the slit edges must be of a type which holds the web against falling back into the container again even through it is wet.

As the web is withdrawn through the slit and being urged for instance toward the right as shown in FIG. 1, it compacts in the slit at the end area thereof and it becomes tighter in the slit toward the end than it is at the center of the slit. The center of the slit gives or bends the most, but in any event, parts or edges of the roving, formed by the slit, are forced outwardly from the center toward the slit ends, which apply greater drag on the web as it extends more closely toward the slit ends, enhancing the severence of the towelettes.

The tear-off or rupture of the lands between the perforations does not occur all at once but is progressive. The lands nearest the ends of the slit start to tear first and as a few tear then those that are closer to the center of the slit will also tear, but later in time and after some progress of the web outwardly, as the web is pulled upon, leaving an exposed tip to be grasped for the next dispensing action.

In the absence of any one of the above attributes, the device will not operate satisfactorily. Briefly, these attributes are:

1. Impervious container.
2. Closeness of slit edges.
3. The give or deformation of the edges of the slit and "memory" thereof.
4. Free-flowing, frictionless compaction of the web in the container.
5. The fact that the slit causes the web to rope.
6. The greater grasp of the slit at its ends on the roped web, with respect to the lesser grasp thereon at the central portion of the slit.
7. The motion outwardly of the roped web while the tearing off or severence progresses.

As shown in FIG. 5, a rectangular container can be used with a slit 26 equivalent to those at 16 or 24, and the toweling or tissue may be continuous and accordian pleated, as described hereinafter.

Figure 7:
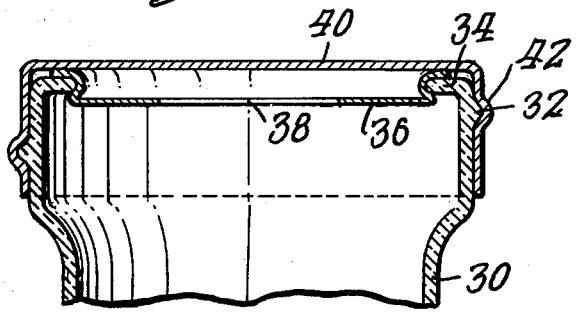
FIG. 7 is a central section through FIG. 6.
Figure 8:
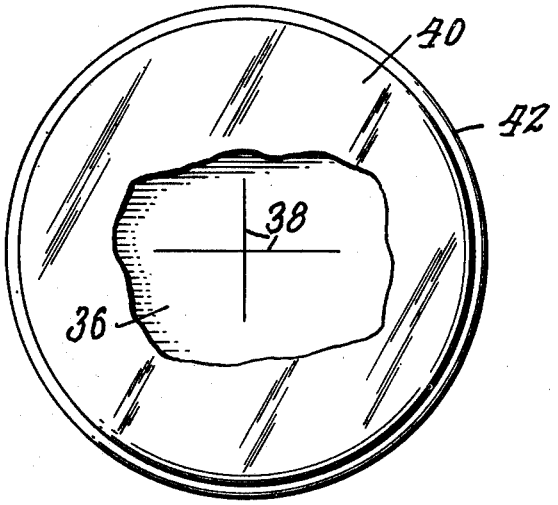
FIG. 8 is a plan view looking in the direction of arrow 8 in FIG. 6 with parts broken away.

Referring now to FIGS. 6, 7, and 8, there is here shown a modified structure which has a removable and replaceable cover 40 for slitted cap 36. There is provided the container 30 which has a screw thread or the like type fastener thereon shown at 32 in FIG. 7. This of course is adjacent the rim of the container which in this case is provided with an inturned rib or the like 34. The inturned rib 34 is annular and received in a snapped-in condition the slitted cap indicated at 36 having a slit of any desired or convenient type as at 38. The slitted cap 36 and slit 38 may be equivalent to the corresponding structures as to cap 14 with slit 16, etc. The cover 40 has a screw thread at 42 corresponding to that at 32 on the container 30. The advantage of the cover 40 and slitted cap 36 resides in their use for products which have a slow use rate, because the cover 40 may be removed and reapplied for storage between uses as often as desired. Also such a container may be stored in a warm place such as a glove compartment of a car where evaporation and drying out of the towelettes could be a problem.

Referring now to FIGS. 9 and 10, the container 44 has a neck at 46 having a continuous exterior bead or the like 48 for releasably retaining a complementary slitted cap 50 having a skirt 52 with an interior bead 54 to snap in under complementary bead 48. The cap 50 is substantially continuous across the top of the container but has a slit or slits 56 centrally thereof. An upstanding beaded lip 58 extends about the slit area on the cap 50. The bead on the lip cooperates with a complementary bead 62 on a like but reversed lip 64 on a captive cover 66 to hold the latter in place by a snap action, covering the slit 56 when not in use. The cover 66 is removable by manual actuation of finger tab 68 to reveal the slit. The cover 66 is made captive as by tab 70 attached to the cap 50. Tab 70 is helpful in removing slitted cap 50 when this is necessary. The material of the cap and cover is of any suitable type such as plastics of commercial nature.

Cover 66 gives protective access to the slitted cap to allow extraction of the absorbent material, and cap and cover are completely removable in case of need. Sealing strips or tear tapes may be used to seal joints between the various parts for shipping and storage. Also a seal in the form of a covering liner or foil membrane may be sealed to the lip of the container as shown at 72 in a conventional manner, thus rendering the container airtight. This seal is easily peeled off for use upon removing cap 50 and reapplying it after the seal is removed.

FIGS. 11 and 12 are directed to a variation of the form shown in FIGS. 9 and 10. Instead of cover 66, cap 50 may have a captive tab 74 with a hanging ring 76 which may be snapped into the beaded lip 62 as was the cover 66. Then, as indicated in FIG. 12, it is easily unsnapped to hang on a hook or on the roll of a toilet tissue fixture, or the like.

FIGS. 13 and 14 show an integrally molded straight tab 78 which may also have an equivalent hanger hole, and this form of tab may have adhesive means e.g., a peel-off pressure sensitive adherent surface 80 to the left of this tab, FIG. 14, in line with the surface of the container for mounting and removal of the dispenser from any supporting surface.

FIG. 15 shows a tangential integral boss 82 with a straight pressure sensitive surface 84 to apply the dispenser adhesively as with tab 78, but boss 82 does not extend up beyond the top surface of its cap, to any appreciable degree.

Figure 16:
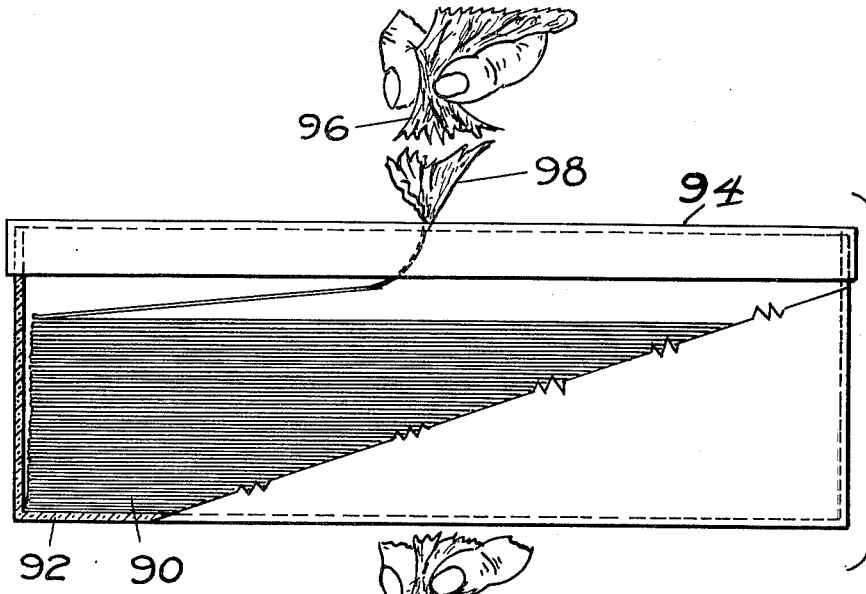
FIG. 16 is a sectional view through a rectangular container illustrating a pleat-folded web stacked horizontally therein.

In the event that it is desired to use pack-folded or accordian pleated webs in stacks, rectangular containers should be used. FIG. 16 illustrates such a web 90 in a packed form, arranged horizontally in a box or the like 92. A cover 94 may be used with the slits previously described, and the severed towel or tissue is indicated at 96 with the leading tips 98 of the succeeding towel or tissue shown in position for the next withdrawal and severing action.

Figure 17:
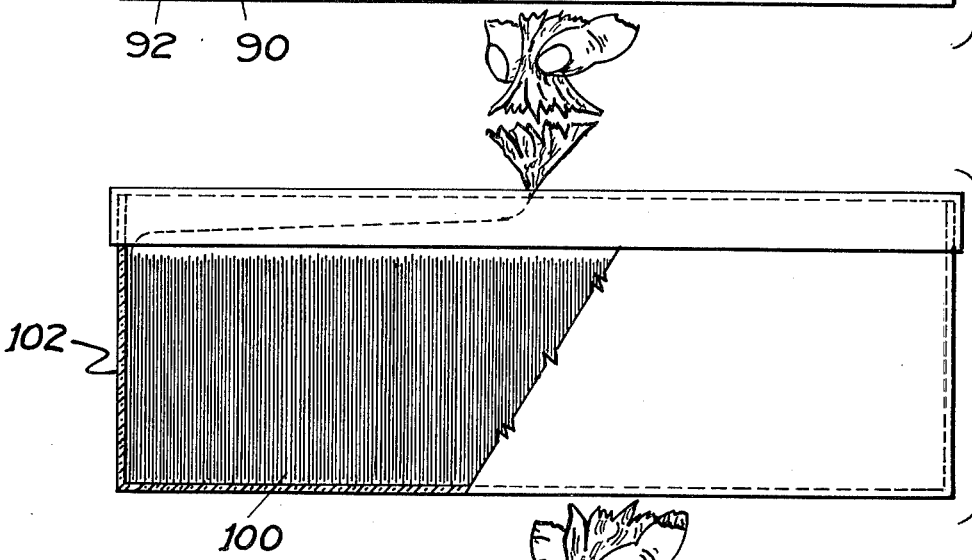
FIG. 17 is a view similar to FIG. 16 illustrating a pleat-folded web stacked vertically.

In certain cases a more even saturation of individual pieces is desirable and this can be obtained by stacking the pleated web vertically in the box, see 100 in FIG. 17, wherein the web is located in the same kind of box 102 as in FIG. 16. In this case the tissues are equally saturated as the impregnating material tends to accumulate in the bottom of the box and each sheet is exposed to a like amount of liquid.

Figure 18:
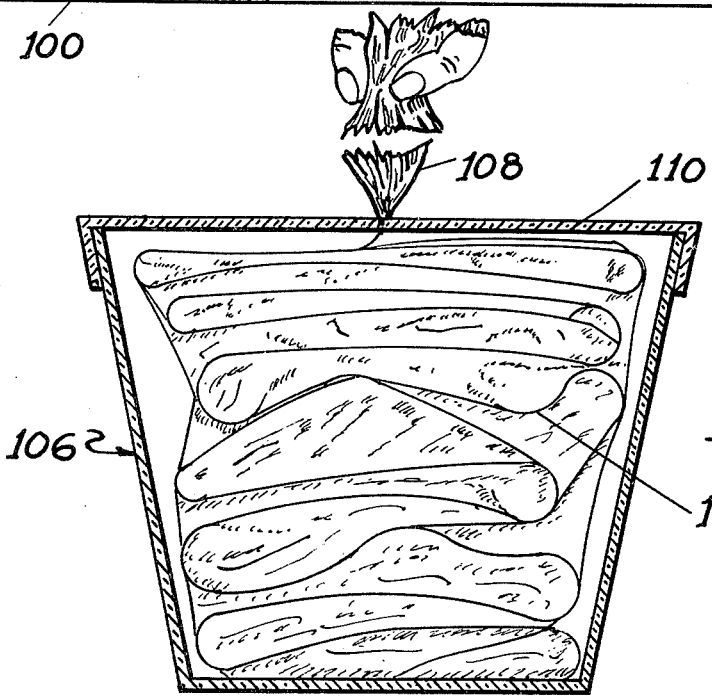
FIG. 18 is a sectional view illustrating a container having a continuous web randomly stuffed therein.

Still another way of arranging the web in the package is to form a rope of the web and randomly stuff it in a box of any shape, as shown as to the web 104 in container 106 in FIG. 18, the extending tip being indicated at 108 and passing through the slit in cover 110. In this case there is no regular form of arrangement of the web in the container.

The withdrawal of the web occasions a wiping action by the edges of the slit, so that in some cases, some moisture will be deposited in the bottom of the container, but in any event the containers are substantially airtight because the slit is always closed or slightly flexed outwardly as the web is pulled out. The web is usually saturated and is therefore referred to as "wet impregnated," and just about fills the slit at all times against evaporation.

We claim:

1. A dispenser containing a continuous web of wet absorbent material in compacted form having sheets connected in end-to-end relationship separated by a scored line, and from which the respective sheets can be readily dispensed, one at a time, comprising:

a self-sustaining container of impervious material, including a body containing a supply of said wet continuous web in a compacted form such as to create a minimum of friction within the body of the container as the web is withdrawn through a dispensing opening in the container, a closure for said container, means defining a dispensing opening for said container through which the web is withdrawn and sheets of said web can be automatically separated as each sheet is pulled through said opening, leaving a tip of the next sheet exposed above the dispensing opening, said means including a slit opening and associated resilient flap edges normally sealing said slit in the absence of the web therebetween wherein said flap edges exert a frictional force on the web as it is pulled therethrough, which force is greater than that necessary to separate adjacent sheets of said web, but which force is insufficient to sever the web in the absence of the scored line, said frictional force exerted by the flap edges on the web being the sole means for causing the web to sever at the scored line above the dispensing opening, thereby exposing the next leading end of the web which may be readily grasped for subsequent extraction of additional sheets, said minimum friction within the body of the container as the web is withdrawn through the dispensing opening in the container, being sufficiently low so as to permit the perforated scored line of said web to at least partially go through the dispensing opening and cause severance of the web above the dispensing opening to ensure that a sufficient amount of the next sheet of said web extends above the opening so that it can be grasped to dispense the next sheet.

2. A package comprising:

a. a self-sustaining container made of an impervious material, b. a web therein of wet continuous sheet-like absorbent material which is transversely perforated at intervals to form individual small sheets when severed at the perforation, c. means defining a dispensing opening having web engaging edges, said opening being at one end of the container through which the leading end of the web extends, said web in the container being in compacted form and capable of extraction through the dispensing opening with a minimum of friction within the container, d. said means including a slit opening having edges to frictionally engage the web during its extraction therethrough, said edges being open and apart while frictionally engaging the web therebetween, such frictional engagement being insufficient to sever the web in the absence of the perforations, e. said slit opening being shorter in length than the width of the web, thus causing the web to rope or compact as it is extracted through the frictionally engaging edges of the slit opening, f. said friction exerted by the slit edges on the web causing severance of the web at the spaced perforations above the dispensing opening and exposing the next leading end of the web which may then be readily grasped for subsequent extraction, and g. the engagement of the web with the slit opening providing a seal means for said container and being the sole means for applying friction or drag to the web to cause said severance.

3. The invention as defined in claim 2 and including a readily detachable cover for sealing said dispensing opening means.

4. The invention as defined in claim 3 and including means for hingedly connecting said cover to said container.

5. The invention as defined in claim 2 wherein said dispensing opening is formed in a closure for said container and said frictionally engaging slit edges each comprise a resilient flap integrally formed on the closure of said body.

6. The invention as defined in claim 2 in which the continuous web material is randomly stuffed in said dispenser.

* * * * *

UNITED STATES PATENT AND TRADEMARK OFFICE

CERTIFICATE OF CORRECTION

PATENT NO. : 4,017,002

DATED : April 12, 1977

INVENTOR(S) : Ross L. Doyle and Thomas S. Harrison

It is certified that error appears in the above-identified patent and that said Letters Patent are hereby corrected as shown below:

Column 1, line 19, "with" should read -- in --.

Column 2, line 21, "screw top" should read -- screw-top --.

Column 2, line 30, "outer" should read -- other --.

Column 7, Claim 1, line 40, -- the -- should be inserted before -- sheets --.

Signed and Sealed this

Fourteenth Day of June 1977

[SEAL]

*Attest:*

RUTH C. MASON
*Attesting Officer*

C. MARSHALL DANN
*Commissioner of Patents and Trademarks*